United States Patent [19]

Watanabe et al.

[11] Patent Number: 4,704,776

[45] Date of Patent: Nov. 10, 1987

[54] PRESS ROLL FOR PAPER MACHINES

[75] Inventors: Atsuo Watanabe, Hirakata; Mikio Fukumitsu, Katano, both of Japan

[73] Assignee: Yamauchi Rubber Industry Co., Ltd., Osaka, Japan

[21] Appl. No.: 856,596

[22] Filed: Apr. 25, 1986

[30] Foreign Application Priority Data

Apr. 30, 1985 [JP] Japan ..... 60-94257

[51] Int. Cl.[4] ..... B30B 3/04

[52] U.S. Cl. ..... 29/132; 29/130

[58] Field of Search ..... 29/130, 132, 129.5, 29/DIG. 25; 100/155 R; 162/287, 363

[56] References Cited

U.S. PATENT DOCUMENTS

| | | | |
|---|---|---|---|
| 2,353,789 | 7/1944 | Schieman | 29/130 |
| 3,165,179 | 1/1965 | Shapland | 29/130 |
| 4,391,879 | 7/1983 | Fabian et al. | 29/132 |
| 4,438,063 | 3/1984 | Suguri et al. | 29/132 |

FOREIGN PATENT DOCUMENTS

| | | | |
|---|---|---|---|
| 0144414 | 8/1983 | Japan | 29/132 |
| 0123490 | 10/1984 | Japan | 29/132 |
| 0158906 | 8/1985 | Japan | 29/132 |
| 2049102 | 12/1980 | United Kingdom | 29/130 |

*Primary Examiner*—Mark Rosenbaum
*Assistant Examiner*—Irene Graves Golabi
*Attorney, Agent, or Firm*—Stiefel, Gross, Kurland & Pavane

[57] ABSTRACT

A paper machine press roll comprising, as integrally joined together, a metal core, a ground layer comprising a metal material layer formed over the outer periphery of the core and having a smaller coefficient of expansion than the surface material of the core, and a ceramics layer formed over the ground layer and having a porosity of 1 to 30%.

19 Claims, 5 Drawing Figures

PRESS ROLL FOR PAPER MACHINES

BACKGROUND OF THE INVENTION

1. Field of the Invention

The present invention relates to a press roll for paper machines, and more particularly to a press roll for use in the press section of a paper machine for removing water from wet paper and making the paper smooth-surfaced.

2. Description of the Prior Art

Roll presses and extended nip presses (ENP) are known as typical means for pressing wet paper for use in the press section of paper machines. The roll press is so adapted that wet paper supported on a felt is passed between two rotary rolls under pressure for the removal of water. With the ENP, wet paper supported on a felt is dewatered by being passed between a rotary roll and a belt to which pressure is applied by a pressure shoe having a large nip width. The rotary roll used in either of these systems has a hard surface in view of the pressing effect and surface smoothness. For example, the roll press comprises the combination of a rotary roll having a hard surface and serving as a top press roll and a rubber-covered roll or the like serving as a bottom press roll.

It is required that such hard-surfaced rotary rolls be usable over a prolonged period of time, withstanding a high load and high-speed rotation. To meet this requirement, stone rolls of natural granite (granite rolls) are widely used. Generally, the stone roll can be mirror-finished over the surface, has high surface hardness, is resistant to abrasion by the doctor blade which is usually provided for removing bits of extraneous stock, permits smooth release of wet paper and is less prone to the deposition of pitch or the like contained in the pulp even when used for a long period. Because of these characteristics, the stone roll has the advantage of being less likely to cause breaks of paper during pressing.

While stone rolls are prepared from natural stone, the stone material is expensive and requires a long period for delivery since the material is difficult to obtain owing to the recent trend toward depletion of resources. In fact, extreme difficulties are encountered in collecting, transporting and processing large stones for making stone rolls which become longer and must be larger than in the past. Further, because the material is a polycrystalline natural stone, there is a substantial problem in that the rolls produced differ in the surface characteristics (such as porosity, surface hardness and water retentivity), even a single roll often differing in such surface characteristics from portion to portion.

In view of the above problems, it has been proposed to replace the stone roll by a synthetic stone roll molded from a mixture of finely divided granite, siliceous sand or the like, and a hard rubber such as NR, NBR, CR or SBR, or a hard resin such as epoxy resin or urethane resin (Unexamined Japanese Patent Publication No. SHO 50-90704, U.S. Pat. No. 2,983,990, etc.). However, the synthetic stone roll has a surface which possesses insufficient water retentivity and poor paper releasability, has low surface hardness and low resistance to the doctor blade due to the use of an organic binder, and is therefore liable to become impaired in smoothness and to permit deposition of pitch. Consequently, the roll is likely to cause breaks of paper in a short period of time and is unfit for long periods of operation. The roll is accordingly often used for pressing wet paper which has been dewatered and given strength by being pressed with a stone roll first.

On the other hand, it has been proposed to use rolls having a ceramic surface layer as conveyor rolls. Ceramic rolls are also proposed which are suited for use in a hot atmosphere as conveyor rolls (Unexamined Japanese Patent Publication No. SHO 58-204884). Nevertheless, it is not known to use ceramics, as proposed by the present invention, for paper machine press rolls which are rotated at a high speed under a heavy load, with water retained in the roll surface.

SUMMARY OF THE INVENTION

The present invention, which has been developed to overcome the above problems, provides a press roll having characteristics superior to the conventional stone rolls. Stated more specifically, the main object of the present invention is to provide a novel paper machine press roll fulfilling the following requirements.

(1) Having a surface with suitable water retentivity which assures smooth release of wet paper and freedom from deposition of extraneous fiber or stock, further giving a proper water content to wet paper on pressing.

(2) Having surface churacteristics less likely to permit deposition of pitch even when the roll is used for a long period of time.

(3) Having surface characteristics adapted for a mirror finish to give smoothness to wet paper upon pressing.

(4) Having surface hardness against abrasion by the doctor blade for removing extraneous fiber or stock and also having roll strength withstanding a high load and high-speed rotation over a prolonged period of time.

(5) Being uniform in the above surface characteristics (1) to (4) over any roll portion and further being free of variations in these characteristics from roll to roll.

(6) Having the foregoing characteristics (1) to (5) as designed and controlled during the fabrication of the roll.

To achieve the above object, the present invention provides a paper machine press roll comprising, an integral metal core, a ground layer comprising a metal material layer formed over the outer periphery of the core and having a smaller coefficient of expansion than the surface material of the core, and a ceramic layer formed over the ground layer and having a porosity of 1 to 30%.

Thus, the press roll of the present invention for use in paper machines comprises a ceramic layer having a porosity of 1 to 30% and formed over the outer periphery of a metal core integral therewith, so that the press roll has the advantages of readily releasing wet paper and being less susceptible to the deposition of pitch and extraneous fiber, stock or the like and resistant to abrasion by the doctor blade. Further, because a ground layer comprising a metal layer having a smaller coefficient of expansion than the metal core is interposed between the core and the ceramic layer, the ceramic layer, the ground layer and the metal core are intimately bonded together, enabling the press roll to fully withstand the conditions of high load (e.g., linear pressure of 250 kg/cm) and high-speed rotation (e.g., 400 rpm at room temperature). The press roll is therefore very useful for paper machine press sections of various types, such as roll press, ENP, etc.

BRIEF,DESCRIPTION OF THE DRAWINGS

DESCRIPTION OF THE PREFERRED EMBODIMENTS

Figure 1:
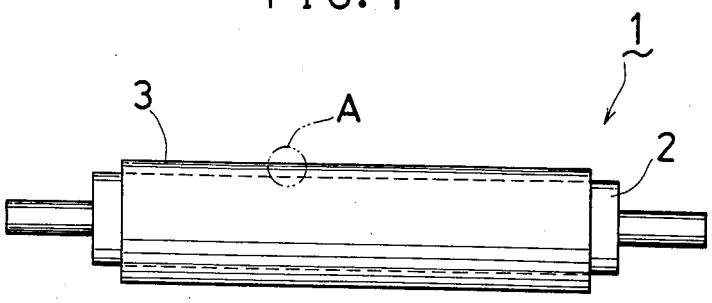
FIG. 1 is a front view showing an embodiment of the press roll of the present invention.

The most characteristic feature of the present invention is that a ceramic layer having a specified porosity is formed over a metal core for usual press rolls. Further to render the roll rotatable at a high-speed under a heavy load over a prolonged period of time, the ceramic layer is firmly bonded to the metal core with a specific ground layer interposed therebetween.

The ceramic layer is set to a porosity of 1 to 30%. This porosity means a value calculated for a corresponding piece of ceramic from the equation $$\text{Porosity} = \frac{g(w-d)}{d} \times 100\ (\%)$$

wherein d is the weight of the piece in a dry state, g is the specific gravity of the ceramic, and w is the weight of the piece when absorbing water. If the porosity is less than 1%, the ceramic layer is excessively compact, with the result that the roll surface has insufficient water retentivity and low wettability, failing to release the wet paper smoothly therefrom when the paper passes over the roll, and hence inappropriate. Conversely, porosities exceeding 30% result in excessively high water retentivity and a reduced water removal efficiency to give a high water content to the pressed wet paper, further impairing the ceramic layer in surface hardness, overall strength and abrasion resistance, thus making the roll unusable for a long period of time.

The ceramic layer may be of a single-layer structure but can be of a multilayer structure composed of two or more layers when so desired. Especially, the combination of a surface layer of small porosity within the above range and an inner layer of great porosity within the same range is desirable in view of the life of the roll, since the inner layer (which is greater than the surface in porosity and therefore has cushioning ability) is then capable of effectively absorbing part of the pressure acting on the roll during a high-load operat:on. Generally in view of the wettability, water retentivity, strength, abrasion resistance and the like of the roll surface, the ceramic layer, when in the form of a single layer, preferably has a porosity of 5 to 20%. If a multilayer structure is used in view of cushioning ability, water retentivity, repeated compressibility, etc., it is desirable that the ceramic structure comprise a surface layer having a similar porosity of 5 to 20% and at least one inner layer having a porosity of 15 to 25%.

Usually, the surface hardness of the ceramic layer is suitably about 400 to about 2000 Hv, preferably 500 to 1500 Hv, in terms of Vickers hardness.

The ceramic layer having such a specified porosity can be readily formed by coating the outer periphery of the metal core usually with a finely divided metallic oxide by a plasma metal spray (water-stabilized plasma metal spray, gas plasma metal spray or the like method, after the ground layer to be described below has been formed over the outer surface of the core. Typical of useful metallic oxides for spray coating are gray alumina (94% $Al_2O_3$-2.5% $TiO_2$), white alumina (99% $Al_2O_3$) titania ($TiO_2$), alumina-titania ($Al_2O_3$—$TiO_2$), mullite ($Al_2O_3$—$SiO_2$), zirconia-mullite ($Al_2O_3$—$ZrO_2$—$SiO_2$) and the like. These metallic oxides can be used in admixture. Further, other metallic oxides which are applicable by spray coating or, when desired, metallic carbides, metallic nitrides or the like, are usable in admixture with such metallic oxides. It is suitable that the spray coating material be 10 to 200 μm in particle size. When thus adjusted in particle size, the material provides a ceramic layer having the desired porosity of 1 to 30%. Usable as the apparatus for plasma metal spray is a water-stabilized plasma metal spray apparatus wherein water is used as the plasma source, or a gas plasma metal spray apparatus wherein argon, helium, hydrogen, nitrogen or the like is used as the plasma source. When the core to be spray-coated is rotated about its axis during coating, a uniform ceramic layer can be formed.

The thickness of the ceramic layer to be formed, which is variable with the size of the contemplated roll, pressure to be applied, etc., is usually suitably 1 to 30 mm. If the thickness is less than 1 mm, low water retentivity and insufficient wet paper releasability will result, whereas thicknesses exceeding 30 mm are almost unable to achieve any improved effect, entail increased cost and are therefore undesirable.

The ceramic layer thus formed is subjected to planish by a surface grinding. Surface roughness of the planished surface of the layer is suitably about 0.1–3 s (Rmax) according to JIS B0601.

The metal core to be used in this invention can be any of those generally used in the art, such as usual metal cores, metal cores which are crowned controllably (crown-controlled rolls or swimming rolls), etc. Useful cores are those made of iron-type metal such as iron or stainless steel, or copper-type metal such as copper or brass, which are capable of providing the rotary shaft of the press roll. Even if the ceramic layer is formed directly over such a metal core which may be made rough-surfaced, it is difficult to obtain intimate adhesion or a strong bond therebetween that would withstand a long period of use as a press roll, owing to a difference in coefficient of expansion. With the roll of the present invention, therefore, a specific ground layer is formed between the metal core and the ceramics layer to bond them together and prevent the core from corrosion. The ground layer comprises a metal layer having a coefficient of expansion which is smaller than that of the surface material of the metal core but greater than that of the ceramic. The metal forming the layer has a coefficient of expansion which is at least smaller than those of iron-type or copper-type metals and which is usually suitably about $9\times10^{-6}$/°C. to $12\times10^{-6}$/°C. From the viewpoint of corrosion resistance, typical of suitable metals are molybdenum-type metals and nickel-type metals. Examples of more preferred metals are nickel-chromium alloys and nickel-chromiun-aluminum alloys. It is suitable to form the metal layer from a powder of such a metal usually by gas spray coating or gas plasma metal spray. It is desirable to make the metal core rough-surfaced before forming the metal layer in view of the bond strength between the layer and the core. The core surface is roughened, for example, by sandblasting, shot blasting or like blasting treatment or by cutting linear grooves or knurling. The ground layer is usually about 100 to about 500 μm in thickness. The ground layer thus formed acts as a kind of cushion in the event of thermal expansion and therefore diminishes the likelihood of separation of the ceramic layer from the metal core due to thermal expansion, consequently providing a strong bond to enable the press roll to withstand a long period of use. The ceramic layer of the present invention and the metal layer formed by spray coating are porous as stated above. Accordingly, water penetrates through the minute pores from the roll surface to the core and is likely to cause corrosion to the core, so that it is desirable to use a metal which is finely divided to the greatest possible extent to give a small porosity to the metal layer. From this viewpoint, the ground layer may comprise a corrosion preventing film in combination with the metal layer. The film is formed between the metal layer and the core and needs to be more compact than the metal layer. It is suitable to form the corrosion preventing film from a finely divided metal having higher corrosion resistance than the core to a thickness of about 100 to about 500 μm by gas spray coating or gas plasma metal spray. Examples of suitable metals are nickel, nickel-aluminum alloy, copper, stainless steel, etc. A more compact film is formed, for example, by using finer particles of spray coating material, or by melting the surface of the film formed to close the pores.

Besides, in order for expecting to a prolong prevention of the deposition of extraneous fiber or stock on the press roll, a release agent may be used to impregnate in the pores of the ceramic layer of the press roll to such extent that the pores are not closed. Silicone plastics, silicone oils, fluoroplastics, etc., may be used as release agents.

The press roll thus fabricated fulfills all of requirements (1) to (6) above for use as a paper machine press roll.

The present invention will be described with reference to the following examples, to which the invention is not limited.

EXAMPLE 1

The metal core used was a hollow cast iron cylinder ($14.0\times10^{-6}$/°C. in coefficient of expansion), 6600 mm in length, 5000 μm in surface length and 490 mm in diameter. The surface of the cylinder was cleaned and degreased with an organic solvent (trichloroethylene) and sandblasted for removing rust and foreign matter and for roughing. While rotating the cylinder, a finely divided nickel-chromium alloy (10 to 44 μm in particle size, SHOCOAT (trademark , product of Showa Denko K.K.) was applied to the outer periphery of the cylinder by a gas spray coating apparatus (using oxygen-acetylene gas) to form a ground layer ($11.5\times10^{-31\ 6}$/°C. in coefficient of expansion) having a thickness of about 100 μm. Subsequently, while rotating the core having the ground layer formed thereon, finely divided mullite, 100 μm in mean particle size, was applied to the ground layer by a water plasma metal spray machine over a period of 6 hours to form a ceramics layer of mullite, 5.3 mm in thickness. The water plasma metal spray operation was conducted under the following conditions.

Input power: 400 V, 400 A (350 kVA)
Spray gun: 380 V, 420 A
Feed of mullite: 40 kg/hr (about 230 kg)
Distance between the gun and the core: 300–400 mm
Traverse speed: 10–20 mm/sec Amount of mullite effectively deposited: About 50%.

Subsequently, the surface (ceramics surface) of the roll obtained was ground with a diamond abrasive stone for finishing to prepare a wet paper press roll 1 shown in FIGS. 1 and 2 and having an outside diameter of 500.2 mm and surface roughness of 0.8s (Rmax) according to JIS B0601. The drawings show the cast iron cylinder 2, the ceramic layer 3 of mullite and the ground layer 4. The ceramic layer was 15% in porosity, 600 Hv in Vickers hardness and $5.3\times10^{-6}$/°C. in coefficient of expansion.

EXAMPLE 2

A hollow cast iron cylinder serving as a metal core and having a length of 7600 mm, a surface length of 6000 mm and a diameter of 580 mm was cleaned or degreased and blasted in the same manner as in Example 1. While rotating the core, finely divided stainless steel (10 to 74 μm in particle size, SHOCOAT (trademark), product of Showa Denko K.K.) was applied to the outer periphery of the core by a gas spray coating apparatus (using oxygen-acetylene gas) to form a film. The surface of the film was melted by spray coating to close the pores and form a corrosion preventing film, 200 μm in thickness, having substantially no pores.

Next, while rotating the core, a finely divided nickel-chromium alloy was applied to the outer surface of the corrosion preventing film by gas spray coating in the same manner as in Example 1 to coat the film with a metal layer, 100 μm in thickness, whereby a ground layer of double-layer structure was formed.

Subsequently, while rotating the core, about 530 kg of finely divided gray alumina, 150 μm in mean particle size, was applied to the ground layer over a period of about 13 hours using the same water plasma metal spray apparatus as used in Example 1 (effective deposition ratio: 50%) to form a ceramic layer (inner layer) of gray alumina, about 8 mm in thickness. The ceramic layer was 20%.

While thereafter rotating the core, about 130 kg of finely divided gray alumina, 70 μm in mean particle size, was applied to the surface of the ceramic layer over a period of about 3.5 hours by water plasma metal spray (effective deposition ratio: 50%) to form a ceramic layer (surface layer) of gray alumina about 2.3 mm in thickness. The surface layer had a porosity of 10% and a surface with Vickers hardness of 700 Hv. The ceramic layer was $8.1\times10^{-6}$/°C. in coefficient of expansion.

Figure 2:
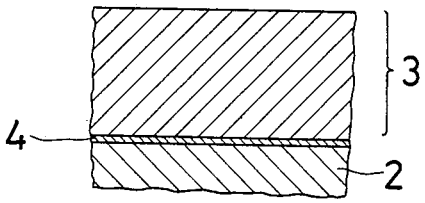
FIG. 2 is a sectional view of the portion A indicated in FIG. 1.
Figure 3:
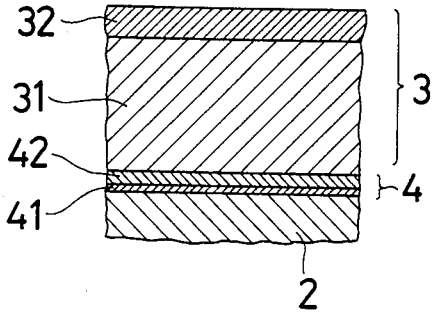
FIG. 3 is a view corresponding to FIG. 2 and showing another embodiment.

The surface of the roll thus obtained was ground for finishing in the same manner as in Example 1 to prepare a press roll having the same shape as shown in FIG. 1, an outside diameter of 600.6 mm and surface roughness of 0.8s (Rmax) according to JIS B0601. FIG. 3 shows the interior structure of the roll. With reference to the drawing, the ground layer 4 is composed of two layers, i.e., a corrosion preventing film 41 of stainless steel and a metal layer 42 of nickel-chromium alloy. The ceramic layer 31 with a porosity of 20% and the ceramic layer 32 with a porosity of 10% provide a ceramic layer 3.

A comparative example with a conventional stone roll corresponding to the rolls of Examples 1 and 2 is one comprising a chromium-molybdenum steel shaft having a length of 6600 mm and a hollow granite cylinder provided around the shaft coaxially therewith at a spacing and having its opposite ends supported by flanges on the shaft, the granite roll being 5000 mm in surface length and 800 mm in diameter.

Figure 5:
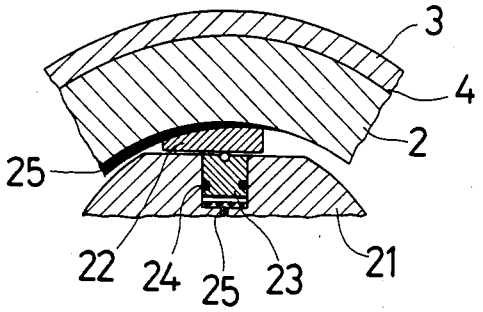
FIG. 5 is a fragmentary view in cross section showing another embodiment of the press roll of the present invention.

FIG. 5 shows another embodiment of the invention wherein a crown controlled roller is used as the metal core. The drawing shows a center shaft 21, a pressure shoe 22, a hydraulic rod 23, a seal 24 and an oil layer 25.

Figure 4:
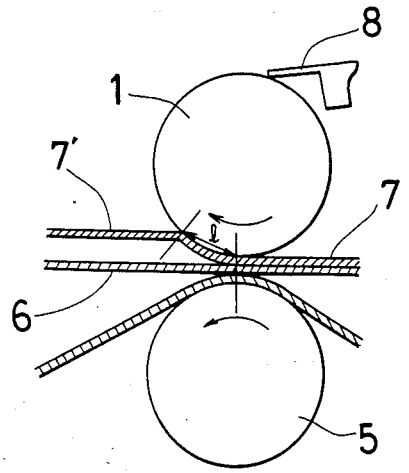
FIG. 4 is a diagram showing the press roll of the invention during a pressing operation.

FIG. 4 shows the press roll prepared in Example 1 or 2 during pressing operation as installed in the press section of a paper machine. With reference to FIG. 4, indicated at 1 is the press roll of the invention serving as a top press roll, at 5 a bottom roll of rubber, at 6 a felt for conveying wet paper, at 7 wet paper before pressing, at 7' the wet paper as pressed, and at 8 a doctor blade for removing extraneous stock from the surface of the roll 1.

Paper machine press rolls, each prepared from the same materials in the same method as the corresponding rolls of Examples 1, 2 and the comparative example, were used as the top roll of the first press as seen in FIG. 4 for a papermaking test. The results are listed below.

The wet paper used for the test had the following composition.

| | |
|---|---|
| Japanese red pine pulp (ground pulp) | 70 parts by weight |
| Coniferous tree bleached pulp (NBKP) | 30 parts by weight |
| Talc | 5 parts by weight |
| Alumina | 3 parts by weight |

The composition had a pH of 4.5.

The specifications of the rolls tested are as follows.

Test press roll of Example 1 (test roll 1):

A roll having an outside diameter of 330.2 mm and comprising a hollow cast iron cylinder, 965 mm in length, 532 mm in surface length and 320 mm in diameter, and the same ground layer and ceramic layer (porosity: 15%) as prepared in Example 1.

Test press roll of Example 2 (test roll 2):

A roll having an outside diameter of 330.6 mm and comprising the same cylinder as test roll 1 except that the diameter is 310 mm, and the same double ground layer and double ceramic layer (inner layer: 20% in porosity and 8 mm in thickness; surface layer: 10% in porosity and 2 mm in thickness) as prepared in Example 2.

Comparative test press roll (stone roll):

A granite roll (porosity: 1.7%) comprising a hollow granite cylinder having the same length and surface length as test roll 1 and a diameter of 330 mm and supported by flanges on a shaft.

Comparative test press roll (synthetic stone roll):

A synthetic stone roll, 360 mm in outside diameter, 532 mm in length and 0 to 1% in porosity, comprising a hollow cast iron cylinder with the same length and surface length as the cylinder of test roll 1, and a sleeve having an outside diameter of 362 mm, an inside diameter of 324 mm and a length of 540 mm and fitted around the cylinder. The sleeve was prepared from the following composition.

| | |
|---|---|
| Rigid urethane resin (liquid) | 100 parts by weight |
| Coarse granite particles (1500 μm in mean size) | 125 parts by weight |
| Coarse siliceous sand particles (800 μm in mean size) | 125 parts by weight |
| Fine granite particles (30 μm in mean size) | 80 parts by weight |

Results of Papermaking Test

| | Stone roll | | Test roll 1 | | Test roll 2 | | Synthetic stone roll |
|---|---|---|---|---|---|---|---|
| 1 Papermaking speed | 27 m/min | | 27 m/min | | 27 m/min | | 27 m/min |
| 2 Weight per unit area | 58 g/m$^2$ | | 58 g/m$^2$ | | 58 g/m$^2$ | | 58 g/m$^2$ |
| 3 Frequency of paper breaks | 4/50 min | | 0/50 min | | 1/50 min | | Paper adhered to roll without release after travelling for about 5 min. |
| 4 Paper release position* | 80 mm | | 70 mm | | 75 mm | | |
| 5 Build-up of extraneous stock on blade | Amount g/min | water content** | Amount g/min | water content** | Amount g/min | water content** | |
| 10 min after start up | 8.0 | 82.4 | 2.6 | 61.5 | 3.5 | 60.3 | Unmeasurable |
| 20 min after start up | 6.7 | 79.1 | 2.1 | 60.3 | 3.3 | 58.9 | |
| 30 min after start up | 7.3 | 77.0 | 2.0 | 59.8 | 3.2 | 57.1 | |
| 50 min after start up | 7.5 | 78.0 | 2.2 | 59.7 | 3.2 | 58.1 | |
| Average | 7.4 | 79.1 | 2.2 | 60.3 | 3.3 | 58.6 | |
| 6 Water content of wet paper after passing 1st press | 67.4% | | 64.1% | | 63.0% | | Unmeasurable |
| 7 Linear pressure | 42.1 kg/cm | | 42.1 kg/cm | | 42.1 kg/cm | | 42.1 kg/cm |
| Porosity | 1.7% | | 15% | | 10% | | 0–1% |

*The term "paper release position" refers to the distance (λ in FIG. 4) from the center point of the nip of the top press roll and the bottom press roll to the position where the paper is released from the roll.
**The water content of the extraneous stock.

These ingredients were uniformly mixed together, placed into a cylindrical rotary mold and cured at about 50° C. for 30 minutes while rotating the mold at such a speed (420 rpm max.) as to obtain an acceleration of 50 G. The molded sleeve was then fitted around the cylinder and adhered thereto with an adhesive injected into the clearance between the cylinder and the sleeve, followed by finishing.

Bottom press roll:

A rubber (polyurethane rubber) roll having a diameter of 340 mm and the same length and surface length as test roll 1.

The foregoing table reveals that the press rolls of the present invention are superior to the stone rolls of the prior art in any of paper releasability, diminution of extraneous stock deposits and water removal efficiency. The stone roll caused four paper breaks during a period of 50 minutes, whereas test roll 1 of the invention operated free of any paper break, and only one break occurred with test roll 2 of the invention.

What is claimed is:

1. A paper machine press roll comprising a metal core, a ground layer comprising a metal layer formed over the outer periphery of the core and having a smaller coefficient of expansion than the surface material of the core, and a ceramic layer formed over the ground layer having a porosity of 1 to 30% the surface of the ceramic layer having a surface roughness or 0.1 to 3s (R max).

2. A press roll as defined in claim 1 wherein the ceramic layer has a porosity of 5 to 20%

3. A press roll as defined in claim 1 wherein the porosity of the ceramic layer is so adjusted that it is small at the surface and greater in the interior thereof.

4. A press roll as defined in any one of claims 1 to 3 wherein the ceramic layer is ceramics coating formed by a plasma metal spray method.

5. A press roll as defined in claim 4 wherein the ceramic layer is made of a metallic oxide ceramics.

6. A press roll as defined in claim 5 wherein the metallic oxide ceramic is gray alumina, white alumina, titania alumina-titania, mullite, zirconia-mullite or zirconia-silica.

7. A press roll as defined in claim 1 wherein the ceramic layer has a thickness of 1 to 30 mm.

8. A press roll as defined in claim 1 wherein the metal core is made of an iron-type metal or copper-type metal.

9. A press roll as defined in claim 8 wherein the iron-type metal is iron or stainless steel.

10. A press roll as defined in claim 8 wherein the copper-type metal is copper or brass.

11. A press roll as defined in claim 1 wherein the ground layer consists only of a metal material layer having a smaller coefficient of expansion than the metal core.

12. A press roll as defined in claim 1 wherein the ground layer comprises a metal layer having a smaller coefficient of expansion than the metal core, and a corrosion preventing film interposed between the metal material layer and the metal core.

13. A press roll as defined in claim 11 or 12 wherein the metal material layer of the ground layer is made of a molybdenum-type metal or nickel-type metal.

14. A press roll as defined in claim 13 wherein the metal material layer of the ground layer is made of a nickel-chromium alloy or nickel-chromium-aluminum alloy.

15. A press roll as defined in claim 11 or 12 wherein the metal layer of the ground layer is formed by gas spray coating or gas plasma metal spray.

16. A press roll as defined in claim 11 or 12 wherein the metal layer of the ground layer has a thickness of about 100 to about 500 μm.

17. A press roll as defined in claim 12 wherein the corrosion preventing film has a thickness of about 100 to about 500 μm.

18. A press roll as defined in claim 1 wherein a relase agent is impregnated in the pores of the ceramic layer in an amount such that the pores are not closed.

19. A press roll as defined in claim 18 wherein the release agent is a silicone plastic, a silicone oil or a fluoroplastic.

* * * * *